United States Patent [19]

Smith

[11] Patent Number: 4,541,561

[45] Date of Patent: Sep. 17, 1985

[54] HEATING EQUIPMENT AND METHOD OF OPERATING SAME

[76] Inventor: Robert E. Smith, 2210 W. Garden St., Peoria, Ill. 61605

[21] Appl. No.: 507,152

[22] Filed: Jun. 23, 1983

[51] Int. Cl.[4] ..... F24D 1/00; F24D 5/00

[52] U.S. Cl. ..... 236/10; 237/53; 126/110 AA

[58] Field of Search ..... 237/51, 53, 50, 49, 237/12.3 C; 126/121, 132, 110 AA, 110 E; 236/11, 10

[56] References Cited

U.S. PATENT DOCUMENTS 2,242,802 5/1941 Stramaglia ..... 126/112 X 4,055,297 10/1977 Lee ..... 236/11

4,171,947 10/1979 Rice ..... 126/91 R

*Primary Examiner*—Henry Bennett

*Attorney, Agent, or Firm*—Bernard L. Kleinke

[57] ABSTRACT

The heating equipment includes an auxiliary heating apparatus having a space heater mounted within an air recirculating furnace system for heating air therein. A thermostat responds to a first predetermined ambient temperature to activate the space heater for heating air within the furnace system. A conduit, connected electrically between the output of the thermostat and the air recirculating blower of the furnace system, sends an electrical signal to the blower to activate it when the thermostat is energized upon the ambient temperature falling below the first predetermined temperature.

8 Claims, 3 Drawing Figures

HEATING EQUIPMENT AND METHOD OF OPERATING SAME

DESCRIPTION

1. Technical Field

The present invention relates in general to a space heating method and equipment. The invention more particularly relates to highly efficient heating equipment for a forced air furnace system, and a method of operating it.

2. Background Art

There have been many types and kinds of heating equipment. For example, reference may be made to the following U.S. Pat. Nos.: 3,994,276; 4,034,912; 4,049,194; 4,069,971; 4,156,455; 4,194,558; and 4,240,404.

The above-mentioned patents disclose different forms of energy efficient devices, such as solar heating equipment, and a waste heat recovery device, disclosed in U.S. Pat. No. 4,194,558. However, it would be highly desirable to have energy efficient heating apparatus, which is adapted to be used with existing forced air furnaces, or the like, to increase greatly the overall efficiency of the heat transfer characteristics of the equipment. Such apparatus should be relatively inexpensive in cost and relatively easy to install. Also, such apparatus should be adapted to be installed in forced air furnace systems to render them much more highly efficient in heat transfer.

DISCLOSURE OF INVENTION

Therefore, the principle object of the present invention is to provide a new and improved space heating method and equipment to provide cost-effective, highly efficient heat transfer characteristics.

Another object of the present invention is to provide a new and improved furnace heating apparatus adapted to be installed in either new or existing forced air furnace systems.

Briefly, the above and further objects of the present invention are realized by providing furnace heating equipment, and a method of operating it, in a highly efficient, cost-effective manner to provide greatly improved heat transfer characteristics.

The heating equipment includes, an auxiliary heatiing apparatus having a space heater mounted within an air recirculating furnace system for heating air therein. A thermostat responds to a first predetermined ambient temperature to activate the space heater for heating air within the furnace system. A conduit, connected electrically between the output of the thermostat and the air recirculating blower of the furnace system, sends an electrical signal to the blower to activate it when the thermostat is energized upon the ambient temperature falling below the first predetermined temperature.

One of the advantages resulting from the use of the method and apparatus of the present invention, is that a relatively inefficient, conventional forced air system can be transformed into a much more efficient system. In this regard, conventional forced air furnace systems are typically about 50 to 60 percent efficient in their heat transfer characteristics. According to one form of the invention, the space heater of the auxiliary heating apparatus is a catalytic heater, which is relatively much more efficient in its heating characteristics—possibly as high as more than 90 percent efficient.

Thus, the overall efficiency of the equipment of the present invention, and the method of operating it, is far beyond conventional heating systems. Yet, the overall added cost of the equipment, is very low as compared to the enormous savings in the cost of fuel for powering the equipment.

BRIEF DESCRIPTION OF DRAWINGS

The above-mentioned and other objects and features of this invention and the manner of attaining them will become apparent, and the invention itself will be best understood by reference to the following description of an embodiment of the invention taken in conjunction with the accompanying drawings, wherein.

BEST MODE FOR CARRYING OUT THE INVENTION

Figures 1, 2, 3:
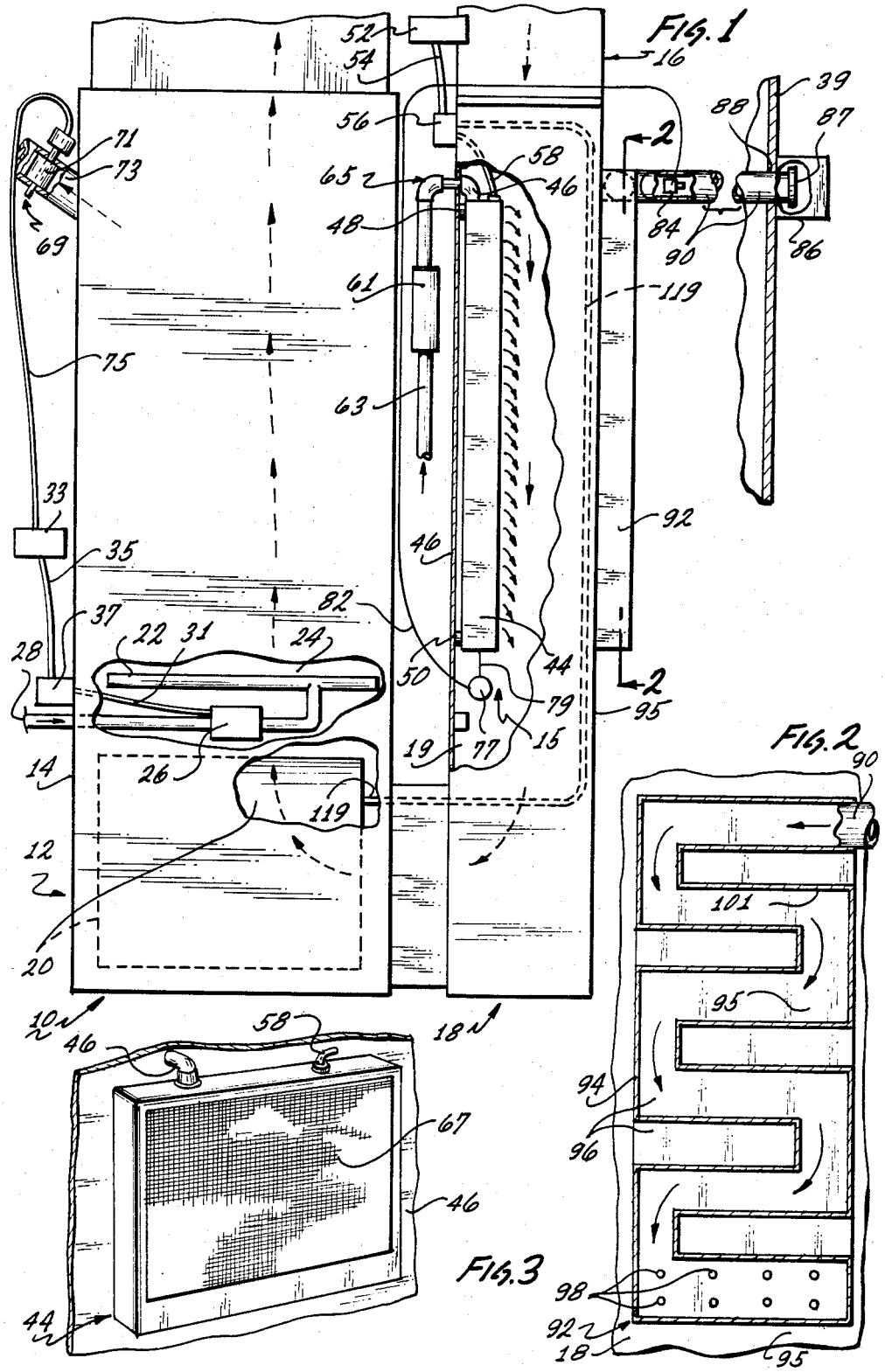
FIG. 1 is a fragmentary, partly schematic, elevational view of space heating equipment, which is constructed in accordance with the present invention, and which includes a forced air furnace system.
FIG. 2 is a sectional view of a pre-heating assembly of the equipment of FIG. 1, taken substantially on line 2—2 thereof.
FIG. 3 is a pictorial view of the space heater shown to a reduced scale and mounted in place within the forced air furnace system of FIG. 1.

Referring now to the drawings, and more particularly to FIG. 1 thereof, there is shown a heating equipment 10, which is constructed in accordance with the present invention.

The equipment 10 generally comprises a forced air furnace system 12, which includes a forced air furnace 14, an auxiliary heating apparatus 15, and a duct system (shown fragmentarily) generally indicated at 16. The apparatus 15 enables the overall system to function at a much higher overall heat transfer characteristic, as compared to the heat transfer characteristics of the furnace 14 alone, as hereinafter explained in greater detail.

The duct system 16, conveys air to a cold air return 18 of the furnace 14. The cold air return 18 includes a cold air return plenum chamber 19.

A blower assembly 20 in the bottom portion of the furnace 12 draws air from the cold air return plenum chamber and conveys it past a gas-fired burner unit 22 mounted within a combustion plenum chamber 24 of the furnace 14.

A gas solenoid valve 26 controls the flow of natural gas from a gas line 28 to the burner unit 24 in response to an electrical signal supplied to the solenoid valve 26 via a conduit 31. A thermostat 33 causes the signal to be generated when the thermostat calls for heat. A conduit 35 is connected electrically between the output of the thermostat 33 and the input of a transformer 37, which has its output connected directly to the conduit 31 for supplying the electrical signal to the valve 26.

The duct system 16 interconnects the outlet (not shown) of the combustion plenum chamber 24 through the space to be heated, such space being, for example, the rooms of a building having outside walls, such as the wall 39. The duct system 16 includes conventional cold air registers (not shown), which convey cold air to the plenum chamber 19, for recirculation through the heating equipment 10.

The auxiliary heating apparatus, generally indicated at 15, heats the air within the cold air plenum chamber 19. The heating apparatus 15 generally comprises a space heater 44 mounted within the plenum chamber 19 on a wall 46 of the cold air return 18 by means of a gas inlet pipe elbow 46 and other mounting devices 48 and 50 (FIG. 1). A thermostat 52 has its electrical output connected through a conduit 54 to the input of a transformer 56, which, in turn, has its output connected via a conduit 58 for causing the space heater 44 to be activated for supplying heat to the cold air plenum 19.

A piezo electric spark ignition unit 61 is used to ignite gas from a natural gas line 63. The outlet of the unit 61 is connected in fluid communication with the space heater 44 to prove heat to the interior of the cold air plenum via pipe line, indicated at 65, to the pipe elbow 46. The unit 61 is disposed on the outside of the cold air return 18, and the pipe line 65 extends through an opening in the cold air return wall 46.

The space heater 44 is a catalytic heater, such as the one sold under the trade name "WARM MORNING", by Locks Stove Company, located at 114 West 11th Street, Kansas City, Mo. 64105. The catalytic heater 44 emits infrared energy to heat the space within the cold air plenum chamber 19.

The heater 44 includes a catalyzing screen 67 (FIG. 3) composed of a suitable catalyst, such as platinum to enable hydrocarbon combustion of gas and oxygen, without a flame, or smoke, at a temperature lower than that required for flame-producing combustion. The primary by-products of combustion are carbon dioxide and water vapor, which are harmless by-products.

Since the heater 44 produces a flameless combustion, there is no need for ventilation for the combustion by-products. Thus, when the heater 44 is operating, an automatic flue damper assembly 69, having a power operated damper 71 is disposed within a flue 73 for the furnace 12, is closed to help improve the heat transfer efficiency of the overall system. In this regard, when the burner 22 of the furnace 14 is not supplying heat, the damper 71 remains closed. When the thermostat 33 calls for heat, an electrical signal is supplied to the damper assembly 69 via an electrical conductor 75 for causing the damper 71 to open.

The heater 44 includes a pilot system schematically indicated generally at 77 which senses the oxygen level within the cold air plenum. A signal is generated when the oxygen content within the plenum chamber 19 falls below a predetermined level, and supplied via a conductor 82 to a blower unit 84 for drawing air into the chamber 19 for replenishing oxygen therein. In this manner, the oxygen level therein can be elevated quickly to maintain a near normal level. Once the oxygen level increases above this predetermined level, the blower unit 84 is then turned off.

A safety device is also included in the pilot system 77 wherein determination of a second predetermined lower oxygen level will cause the heater to shut off automatically. For this purpose, an electrical signal is generated and supplied via a conductor 79 to the controls (not shown) for the heater 44. By this, the oxygen level is quickly raised above this lower secondary safety level, and the pilot system 77 permits the heater 44 to resume functioning.

The blower unit 84 draws outside air through a flapper unit 86 having a flapper 87 mounted over an opening 88 in the outside wall 39, through a conduit or pipe 90, to a pre-heater unit 92. The unit 92 is used to preheat the outside air before in enters the chamber 19 to enhance the efficiency of the overall system.

As shown in FIG. 2, the unit 92 comprises a hollow metal housing 94 mounted on a wall 95, opposite the wall 46, of the cold air return 18. The unit 92 has an irregular air flow passage 96 indicated by the arrows to guide the air flow from the pipe 92 to a series of holes 98 drilled in the wall 95 for directing the preheated air to the heater 44. The housing 94 is rectangular in shape, as seen in FIG. 2, and is open at the side engaging the wall 95, so that the air is warmed by the heated wall 95.

A series of baffles, such as the baffle 101, are arranged in a zig-zag manner, to facilitate the heating of the air flowing therethrough.

In operation, the thermostat 52 is set at a higher temperature than the temperature setting for the thermostat 33. Thus, the heating apparatus 15 provides heat for the chamber 19 whenever the thermostat 52 calls for heat. In this regard, a cable or conductor 119 supplies a signal from the transformer 56 to start the blower 20 whenever the thermostat 52 calls for heat. Thus, the blower 20 recirculates the heat from the heater 44 for space heating purposes.

In severely cold ambient conditions, the thermostat 33 will also call for heat, and both the unit 22 and the heater 44 will supply heat, and the damper 71 opens.

I claim:

1. Heating equipment having a heating unit for heating space within a building, comprising:

a forced air furnace having an air recirculating system including an air recirculating blower means, said recirculating system including a cold air return having a cold air return plenum chamber through which flows cold air in a downward direction from said space to said furnace for heating by said unit;

catalytic space heating means;

means for mounting said space heating means wholly within said plenum chamber for heating the cold air therein;

first thermostat means responsive to a first higher predetermined ambient temperature for activating said space heating means for heating air within said recirculating system;

first conduit means connected electrically between the output of said thermostat means and the air recirculating blower means of the furnace system for sending an electrical signal to said blower means to activate it when said thermostat means is energized upon the ambient temperature falling below said first predetermined temperature to draw said cold air downwardly through said cold air plenum chamber into contact with said space heating means for heating said cold air flowing therepast;

means defining at least one opening in said plenum chamber;

conduit means disposed on the outside of said plenum chamber and connected in fluid communication with the interior of said chamber via said opening;

auxiliary blower means for supplying air to said heating means via said conduit to the interior of said plenum chamber to facilitate the activation of said heating means; and second thermostat means and second conduit means responsive to a second lower predetermined ambient temperature for activating the heating unit of the forced air furnace to provide auxiliary heating for the space within the building.

2. In an air recirculating furnace system having an air recirculating blower means, said system having a furnace and having a cold air plenum chamber therefor, heating apparatus comprising:

catalytic space heating means;

means for mounting said space heating means wholly within said plenum chamber for heating air therein;

thermostat means responsive to a first predetermined ambient temperature for activating said space heating means for heating air within said plenum chamber;

conduit means connected between the output of said thermostat means and the air recirculating blower means of the furnace system for sending an electrical signal to said blower means to activate it when said thermostat means is energized upon the ambient temperature falling below said first predetermined temperature to draw said cold air downwardly through said cold air plenum chamber into contact with said space heating means for heating said cold air flowing therepast;

means defining at least one opening in said plenum chamber;

conduit means disposed on the outside of said plenum chamber and connected in fluid communication with the interior of said chamber via said opening; and auxiliary blower means for supplying air to said heating means via said conduit to the interior of said plenum chamber to facilitate the activation of said heating means.

3. A method of heating air within a building by using an air recirculating furnace system having an air recirculating blower means, said system having a furnace and having a cold air plenum chamber therefor, comprising:

using catalytic space heating means wholly within the cold air plenum chamber for heating cold air therewithin;

activating said space heating means for heating air within said plenum chamber in response to a first predetermined ambient temperature;

pulling said cold air downwardly within said cold air plenum chamber into contact with said heating means for heating said cold air as it flows past said heating means, when the ambient temperature falls below said first predetermined temperature; and flowing air from outside the building to said heating means through an opening in said plenum chamber to facilitate the activation of said heating means.

4. Heating equipment according to claim 1, further including pre-heating means for heating said air before contacting said heating means.

5. Heating apparatus according to claim 2, further including pre-heating means for heating said air before contacting said heating means.

6. A method according to claim 3, further including preheating said outside air prior to supplying it to said heater.

7. Heating equipment according to claim 4, wherein said pre-heating means includes a housing mounted on the outside of said plenum chamber, and includes means defining an irregular air flow passage connected in fluid communication with said opening, so that the air flowing therethrough is heated by conduction of heat outwardly from the plenum chamber and into said air flow passage.

8. Heating equipment according to claim 5, wherein said pre-heating means includes a housing mounted on the outside of said plenum chamber, and includes means defining an irregular air flow passage connected in fluid communication with said opening, so that the air flowing therethrough is heated by conduction of heat outwardly from the plenum chamber and into said air flow passage.

* * * * *